US006343413B1

(12) United States Patent
Masuda et al.

(10) Patent No.: US 6,343,413 B1
(45) Date of Patent: Feb. 5, 2002

(54) METHOD OF MANUFACTURING A CHIP INDUCTOR

(75) Inventors: Hiroyuki Masuda; Kinya Iri; Kenichiro Nogi; Nobuo Mamada, all of Tokyo (JP)

(73) Assignee: Taiyo Yuden Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/650,755

(22) Filed: Aug. 30, 2000

Related U.S. Application Data

(62) Division of application No. 09/207,678, filed on Dec. 9, 1998, now Pat. No. 6,189,202, which is a division of application No. 08/916,257, filed on Aug. 22, 1997, which is a continuation of application No. 08/543,989, filed on Oct. 7, 1995, now abandoned.

(30) Foreign Application Priority Data

Oct. 19, 1994 (JP) ..... 6-253832
May 2, 1995 (JP) ..... 7-108541

(51) Int. Cl.[7] ..... H01F 41/06
(52) U.S. Cl. ..... 29/605; 29/608
(58) Field of Search ..... 29/605, 608; 336/233, 336/192; 264/272.19

(56) References Cited

U.S. PATENT DOCUMENTS

| | | | | |
|---|---|---|---|---|
| 644,312 A | | 2/1900 | Anderson | 336/206 |
| 1,306,815 A | | 6/1919 | Houchin et al. | 336/177 |
| 2,521,536 A | | 9/1950 | Reardon | 336/177 |
| 3,458,650 A | | 7/1969 | Miyawaki et al. | 336/206 |
| 4,696,100 A | | 9/1987 | Yamamoto et al | 336/83 |
| 4,842,352 A | | 6/1989 | Sasaki et al | 336/83 |
| 5,544,410 A | * | 8/1996 | Kato et al. | 29/608 X |

FOREIGN PATENT DOCUMENTS

| | | |
|---|---|---|
| JP | 58-48410 | 3/1983 |
| JP | 59-151407 | 8/1984 |
| JP | 6-5427 | 1/1994 |
| JP | 7-74024 | 3/1995 |

* cited by examiner

*Primary Examiner*—Carl E. Hall
(74) *Attorney, Agent, or Firm*—Armstrong, Westerman, Hattori, McLeland & Naughton, LLP

(57) ABSTRACT

A chip inductor is made up of a coiled conducting wire and a magnetic member which is formed by sintering and in which the coiled conducting wire is embedded. Both end portions of the coiled conducting wire are exposed to both end surfaces of the magnetic member. External electrodes are formed with conducting thin films and are connected to respective end portions of the coiled conducting wire. An inorganic material is interposed in a clearance between winds of both end portions of the conducting wire and external surfaces of the magnetic member and a clearance between adjoining winds of the conducting wire.

2 Claims, 6 Drawing Sheets

METHOD OF MANUFACTURING A CHIP INDUCTOR

This application is a division of prior application Ser. No. 09/207,678 filed Dec. 9, 1998 now U.S. Pat. No. 6,189,202; which is a division of prior application Ser. No. 08/916,257 filed Aug. 22, 1997; which is a continuation of prior application Ser. No. 08/543,989 filed Oct. 17, 1995 (abandoned).

BACKGROUND OF THE INVENTION

1. Field of the Invention

The present invention relates to a chip inductor and a chip inductor array which use a sintered magnetic member and also relates to a method of manufacturing the same.

2. Description of Related Art

Conventionally, there is proposed a chip inductor which is manufactured in the following manner. Namely, a kneaded material to be obtained by kneading a powdered magnetic material (or magnetic substance) and a binder is pressurized to form it into a rectangular parallelepiped or a cylindrical body and thereafter sinter it to manufacture a bar of the magnetic material. A conductor (or a conducting wire) is wound around the bar of the magnetic material to thereby mount a coil in a coiled manner. An external cover element is formed with the kneaded material of the powdered magnetic material and the binder to cover the coiled conducting wire. The semimanufactured product obtained in the above steps is sintered. External electrodes which are connected to both end portions of the coiled conducting wire are formed on external surfaces of the magnetic member by coating a conducting paste on external surfaces of the magnetic member.

The coiled conducting wire of the above-described conventional chip inductor is covered with the magnetic material. Therefore, a circular magnetic circuit is formed in a manner to enclose the coiled conducting wire, with the result that an inductance value is high and that there is little or no magnetic field to leak outside the magnetic material. It has consequently an advantage in that, even if the chip inductor is disposed in close proximity to other parts, there will be no influence on the characteristics as an inductor and therefore that a density of mounting parts on a wiring circuit board or the like can be made higher.

However, this inductor has the following disadvantages. Namely, when the external element is formed around the magnetic bar-like body around which the conducting wire is wound, the kneaded material is hard to enter the clearance between the winds of the coiled conducting wire on both ends thereof and the external surfaces of the magnetic member as well as the clearance between respective winds of the conducting wire. Therefore, when the external electrodes are formed, after sintering, by coating the conducting paste on the external surfaces of the magnetic member, the conducting paste is likely to enter the clearance between the external surfaces of the magnetic member and the winds on both ends of the coiled conducting wire. As a result, the conducting paste comes into contact with the winds of the conducting wire to thereby short-circuit a part or whole circumference of the winds of the conducting wire, resulting in a variation in the impedance characteristics. Further, the conventional method of manufacturing the inductor has, aside from the above-described disadvantage in that it is not suitable for mass production, another disadvantage in that, due to shrinkage of the kneaded material for the external cover element at the time of sintering, a pressure is applied to the internal magnetic element via the coiled conducting wire and/or via a clearance between winds of the coiled conducting wire. The magnetic characteristics are consequently badly affected and the impedance characteristics are deteriorated.

SUMMARY OF THE INVENTION

The present invention has an object of providing a chip inductor and a chip inductor array which are free from the above-described disadvantages and which are suitable for mass production and superior in, and do not fluctuate in, impedance characteristics. It has also an object of providing a method of manufacturing the same.

In order to attain the above and other objects, the present invention provides a chip inductor comprising: a coiled conducting wire; a magnetic member which is formed by sintering and in which the coiled conducting wire is embedded; wherein both end portions of the coiled conducting wire are exposed to both end surfaces of the magnetic member; external electrodes which are formed with conducting thin films and which are connected to respective end portions of the coiled conducting wire; and an inorganic material which is interposed in a clearance between winds on both end portions of the conducting wire and external surfaces of the magnetic member and a clearance between adjoining winds of the conducting wire.

The inorganic material may be wound around a winding core inside the magnetic member in a coiled manner together with the conducting wire in a side by side relationship with each other.

The conducting wire may be coated on an external surface thereof with the inorganic material and is closely wound.

Preferably, the inorganic material is a magnetic material, a dielectric material, or an electrically insulating material.

According to another aspect of the invention, there is provided a method of manufacturing a chip inductor comprising the steps, in the order mentioned, of: forming an elongated winding core by extruding a kneaded material which is obtained by kneading a powdered magnetic material and a binder; winding a conducting wire around the winding core in a coiled manner; filling an inorganic material which is free from perishing by sintering into a clearance between adjoining winds of the conducting wire by covering the winding core wound by the conducting wire with the inorganic material; forming an external cover element by extruding the kneaded material to cover the winding core and the conducting wire, the winding core and the external cover element constituting a magnetic member; sintering the winding core, the inorganic material, and the external cover element to thereby obtain a continuously formed chip inductor main body; cutting the continuously formed chip inductor main body into a predetermined length to thereby obtain a plurality of cut chip inductor main bodies, each of the cut chip inductor main bodies having the inorganic material interposed in a clearance between a wind on each end of the conducting wire and each of external surfaces of the magnetic member and a clearance between adjoining winds of the conducting wire; and forming a conducting coating on each of the external surfaces of the magnetic member of each of the cut chip inductor main bodies, the conducting coating serving as an external electrode connected to each exposed end of the conducting wire.

Preferably, the step of filling an inorganic material into a clearance is performed by extruding, by spraying, by dipping, by winding the inorganic material around the winding core in a coiled manner together with the conducting wire in a side by side relationship with each other, or by closely winding the conducting wire, which is coated on an external surface thereof with the inorganic material, in a coiled manner around the winding core.

The inorganic material may be a magnetic material, a dielectric material, or an electrically insulating material.

According to still another aspect of the invention, there is provided a chip inductor comprising: a plurality of conducting wires closely wound in a coiled manner, each being coated on an external surface thereof with an electrically insulating inorganic material which is free from perishing by sintering; a magnetic member in which the plurality of conducting wires are parallelly embedded; connecting electrodes to connect in series exposed ends of each of the conducting wires; and external electrodes which are connected to respective end portions of the connected conducting wires.

According to still another aspect of the invention, there is provided a method of manufacturing a chip inductor comprising the steps, in the order mentioned, of: forming a plurality of parallelly disposed elongated winding cores by extruding a kneaded material which is obtained by kneading a powdered magnetic material and a binder; closely winding a conducting wire in a coiled manner around each of the winding cores, the conducting wire being coated on an external surface thereof with an electrically insulating inorganic material which is free from perishing by sintering; forming an external cover element by extruding the kneaded material to continuously cover each of the winding cores and each of the coiled conducting wires, the winding cores and the external cover element constituting a magnetic member; sintering the winding cores and the external cover element to thereby obtain a continuously formed chip inductor main body; cutting the continuously formed chip inductor main body into a predetermined length to thereby obtain a plurality of cut chip inductor main bodies; and forming connecting electrodes to connect in series exposed ends of each of the conducting wires and external electrodes connected to respective end portions of the connected conducting wires.

According to still another aspect of the invention, there is provided a chip inductor array comprising: a plurality of conducting wires closely wound in a coiled manner, each being coated on an external surface thereof with an electrically insulating inorganic material which is free from perishing by sintering; a magnetic member in which the plurality of conducting wires are parallelly embedded; and external electrodes which are formed on external surfaces of the magnetic member and which are connected to both exposed ends of each of the conducting wires.

The method of manufacturing a chip inductor array comprises the steps, in the order mentioned, of: forming a plurality of parallelly disposed elongated winding cores by extruding a kneaded material which is obtained by kneading a powdered magnetic material and a binder; closely winding a conducting wire in a coiled manner around each of the winding cores, the conducting wire being coated on an external surface thereof with an electrically insulating inorganic material which is free from perishing by sintering; forming an external cover element by extruding the kneaded material to continuously cover each of the winding cores and each of the coiled conducting wires, the winding cores and the external cover element constituting a magnetic member; sintering the winding cores and the external cover element to thereby obtain a continuously formed chip inductor array main body; cutting the continuously formed chip inductor array main body into a predetermined length to thereby obtain a plurality of cut chip inductor array main bodies; and forming external electrodes which are respectively connected to exposed end portions of each of the plurality of winding cores. The external electrodes are formed on external surfaces of the magnetic member.

Preferably, a mixing ratio of the powdered magnetic material and the binder of the winding core is equal to a mixing ratio of the powdered magnetic material and the binder of the external cover element, and a particle size of the powdered magnetic material for the winding core is equal to a particle size of the powdered magnetic material for the external cover element such that a shrinkage percentage of the winding core becomes equal to a shrinkage percentage of the external cover element.

The above-described chip inductor and chip inductor array have the inorganic material in a preferred form of the magnetic material, the dielectric material, or the electrically insulating material which is interposed in a clearance between winds on both end portions of the conducting wire and external surfaces of the magnetic member and a clearance between adjoining winds of the conducting wire. Therefore, when the external electrodes and/or connecting electrodes which are made with conducting coatings are formed on external surfaces of each of the chip inductor main bodies or the chip inductor array main bodies, the conducting paste does neither enter nor contact the ends on both end portions of the conducting wire. As a result, the coiled conducting wire is not short-circuited by the conducting paste and, consequently, the impedance value does not fluctuate. In case this inorganic material is the magnetic material, the clearance between the winds of the conducting wire is filled with the magnetic material and, therefore, the impedance characteristics are improved. In case the inorganic material is the dielectric material, when the inductor is used for removing noises, the distributed capacitance between the winds becomes large and, therefore, the attenuation characteristics of the signals become steeper than the conventional one without the dielectric material layer. A chip inductor and chip inductor array which are superior in frequency selection characteristics can thus be obtained, and they can be effectively used in case where the frequencies of the signals to be transmitted and of the noises to be reduced are close to each other.

When an elongated winding core is formed by extruding a kneaded material which is obtained by kneading a powdered magnetic material and a binder, and the inorganic material is filled into the clearance preferably by winding the inorganic material around the winding core in a coiled manner together with the conducting wire in a side by side relationship with each other, and when the conducting wire which is coated on an external surface thereof with an electrically insulating inorganic material which is free from perishing by sintering, is closely wound in a coiled manner around the winding core, the winds of the conducting wire do not come into contact with each other. Therefore, as compared with the one in which the conducting wire without the coating is wound, the conducting wire can be wound more closely, with the result that the impedance characteristics can be improved and that the chip inductor and the chip inductor array can be made smaller in size.

According to the present invention, a plurality of chip inductor main bodies can be manufactured at the same time by the following steps, namely, in one aspect, a first step of forming an elongated winding core by extruding a kneaded material which is obtained by kneading a powdered material and a binder, and a second step of winding a conducting wire around the winding core in a coiled manner, and a third step of filling an inorganic material which is free from perishing by sintering into a clearance between adjoining winds of the conducting wire by covering the winding core wound by the conducting wire with the inorganic material, preferably by means of extruding, by spraying, or by dipping, or else by winding the inorganic material around the winding core in a coiled manner together with the conducting wire in a side by side relationship with each other; and in another aspect, a first step of forming a plurality of parallelly disposed elongated winding cores by extruding a kneaded material which is obtained by kneading a powdered magnetic material and a binder, and a second step of closely winding a conducting wire which is coated on an external surface thereof with an electrically insulating inorganic material which is free from perishing by sintering, in a coiled manner around each of the winding cores; and in both aspects, thereafter by the step of forming an external cover element by extruding the kneaded material to cover one or a plurality of winding cores and the conducting wires (the winding core and the external cover member constitute a magnetic member), and the step of sintering the winding core or cores, the inorganic material, and the external cover element to thereby obtain a continuously formed chip inductor main body, and the step of cutting the continuously formed chip inductor main body into a predetermined length to thereby obtain a plurality of cut chip inductor main bodies.

In manufacturing a chip inductor array of the present invention, a plurality of inductor main bodies manufactured in the method of a still another aspect of the present invention can be utilized. Preferably, a mixing ratio of the powdered magnetic material and the binder of the winding core is made equal to a mixing ratio of the powdered magnetic material and the binder of the external cover element, and a particle size of the powdered magnetic material for the winding core is made equal to a particle size of the powdered magnetic material for the external cover element so that a shrinkage percentage of the winding core becomes equal to a shrinkage percentage of the external cover element. Then, the stress due to shrinkage of the external cover element at the time of sintering is not applied to the winding core via the coiled conducting wire and/or via the clearance between adjoining winds of the conducting wire. The impedance characteristics are thus not impaired, and the impedance is improved as compared with the conventional inductor.

BRIEF DESCRIPTION OF THE DRAWINGS

The above and other objects and the attendant advantages of the present invention will become readily apparent by reference to the following detailed description when considered in conjunction with the accompanied drawings wherein.

DETAILED DESCRIPTION OF PREFERRED EMBODIMENTS

An explanation will now be made about embodying examples of the present invention with reference to the accompanying drawings.

Figure 1A:
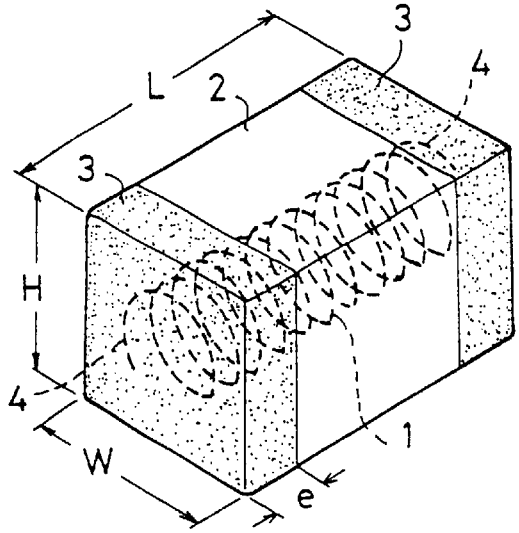
FIGS. 1A and 1B are a perspective view and a sectional view of one example of the chip inductor according to the present invention.
Figure 1B:
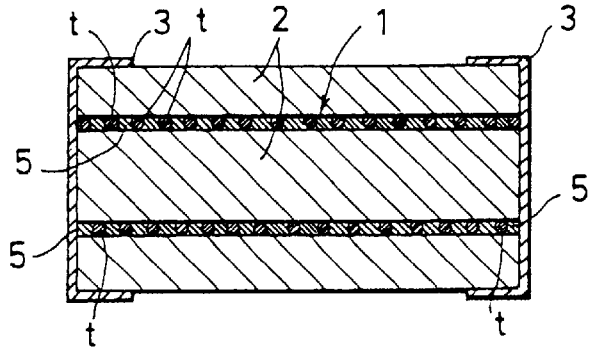

FIGS. 1A and 1B represent one embodying example of the chip inductor of the present invention.

In these Figures, reference numeral 1 denotes a conductor wound in a coiled manner (or a coiled conducting wire) which was formed by winding a conducting wire made of a silver wire of 20–100 $\mu$m in diameter. Reference numeral 2 denotes a magnetic member of a rectangular parallelepiped in which was embedded the coiled conducting wire 1 and which was made of ferrite (e.g., L=1.0–10.0 mm, W=0.5–10.0 mm, H=0.5–10.0 mm). Reference numerals 3, 3 denote external electrodes which were made by coating both end surfaces and adjoining external peripheral end portions (e=0–4.0 mm) of the magnetic member 2. The external electrodes 3, 3 were connected to those both end portions 4, 4 of the coiled conducting wire 1 which were exposed to both the end surfaces of the magnetic member 2. These external electrodes 3, 3 were made, for example, of thin films of silver and were subjected to nickel plating or lead-tin plating on top thereof.

Figure 2:
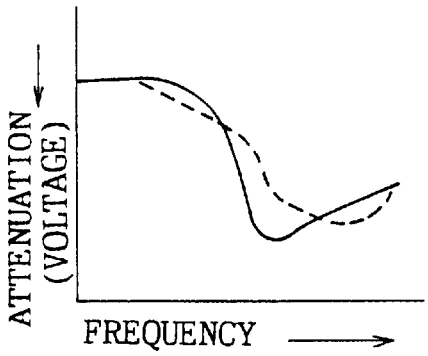
FIG. 2 is a diagram showing attenuation characteristics of the chip inductor of the present invention.

The above-described magnetic member 2 was made up of an internal magnetic element which serves as a winding core around which the coiled conducting wire 1 is wound and a magnetic element which serves as an external cover element to cover or coat the coiled conducting wire 1. Both magnetic elements were made up a ferrite of the same composition, e.g., of iron, nickel, zinc, copper or the like and had a permeability of 100, for example. The internal magnetic element was manufactured by forming a kneaded material of columnar shape with a kneaded material of a powdered magnetic material (or raw meal of a magnetic material) of 0.7 $\mu$m in particle size and a binder of glycerine-methyl cellulose, both being mixed in the ratio of 100:8, and thereafter sintering the kneaded material. After sintering, a semimanufactured product had a shrinkage ratio (=a dimension of kneaded material/a dimension of sintered material) of 1.3, which can be represented in terms of a shrinkage percentage of 23%. This shrinkage at the time of sintering is also called a firing shrinkage and can be represented by a formula $\{(l_0-l_1)/l_0\}\times 100$, where $l_0$ is the length of the formed semimanufactured product before sintering and $l_1$ is the length after sintering it. The magnetic element which serves as the external cover element was made up of the powdered magnetic material of the same composition and particle size as those of the above-described internal magnetic element, and the same binder, which were mixed in the same mixing ratio and were then sintered. With the above-described shrinkage percentage, the parallelepiped of 4.16 mm both in height (H) and in width (W) became, after sintering, both 3.2 mm. The winding core, on the other hand, of 2.6 mm in diameter inside the coiled conducting wire 1 became 2.0 mm after sintering. The clearance between the coiled conducting wire 1 and the magnetic element in the form of the winding core was formed into zero. Reference numeral 5 denotes an inorganic material layer which was made up of a magnetic material, a dielectric material, glass or the like which was interposed between winds t, t, on both ends, of the conducting wire 1 and both end surfaces of the winding core 2 as well as in the clearance between respective winds t, t of the coiled conducting wire 1. Due to the interposing of this inorganic material layer 5, when the external electrodes 3, 3 are formed on both end surfaces of the magnetic member 2 with an electrically conducting paste or the like, the electrically conducting paste does not enter the clearance and therefore does not contact the winds t, t on both ends. As a result, a deviation in inductance equivalent to a maximum of one wind of coiled conducting wire can be prevented. In case the inorganic material layer to be interposed in each of the winds t, t of the coiled conducting wire is a magnetic material layer, an impedance will increase as compared with the conventional one. In case the inorganic material layer is a dielectric material layer made up of a ceramic which comprises $BaTiO_3$, $MgTiO_3$, $SrTiO_3$, $CaTiO_3$, $TiO_2$ or a combination thereof, when the inductor is used to remove noises, the distributed capacitance between each wind of the conducting wire becomes large. As shown by a solid line in FIG. 2, the attenuation characteristics of signals become steeper as compared with the one which has no dielectric material layer (shown by a dotted line), with the result that a product of improved frequency selection characteristics can be obtained. Therefore, it is effective for use in which the frequency of a signal to be transmitted and the frequency of a noise to be reduced are close to each other. The characteristics shown in FIG. 2 were measured by using a measuring circuit in which a signal source was connected to a second resistance of 50 Ω via a first resistance of 50 Ω and an inductor, and a voltmeter was connected to both ends of the second resistance.

Figure 3:
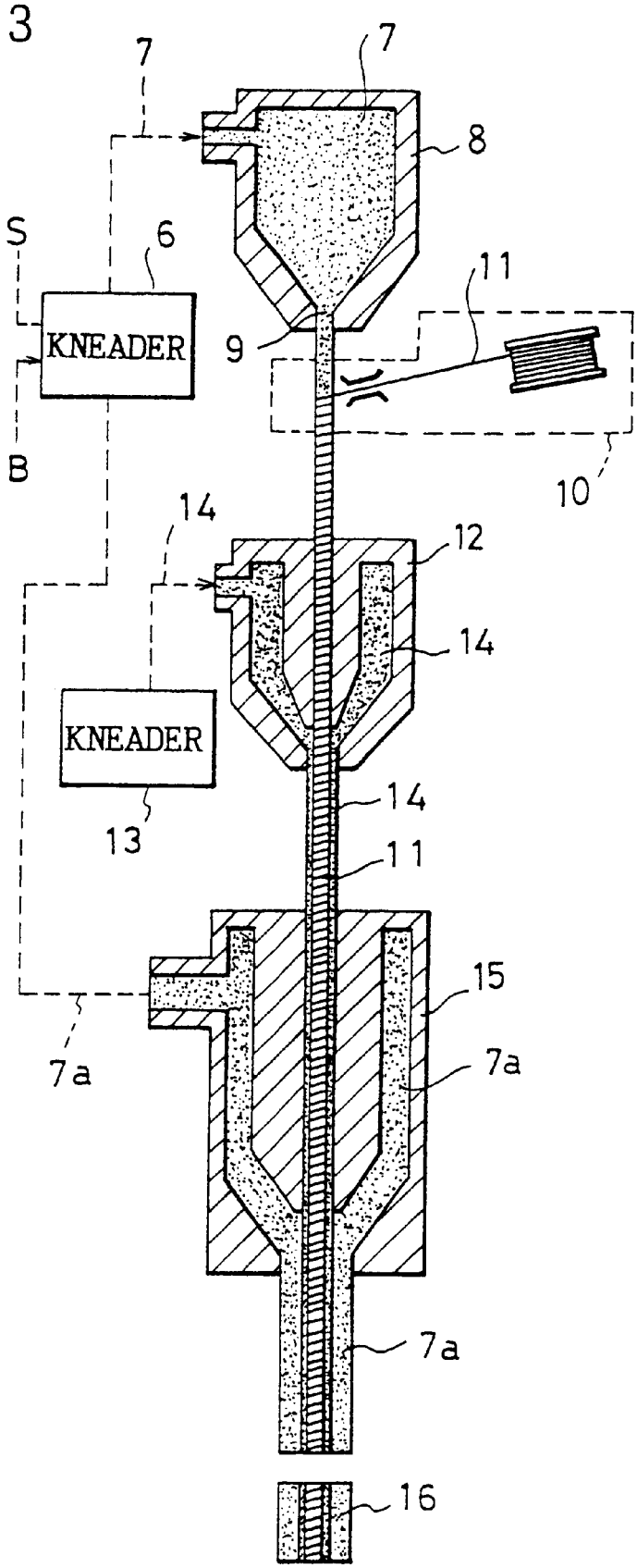
FIG. 3 is an explanation diagram showing a method of manufacturing the chip inductor of the present invention.

Next, an explanation will now be made about the method of manufacturing the chip inductor of the present invention as shown in FIGS. 1A and 1B. As shown in FIG. 3, a binder S and a powdered magnetic material B of the above-described mixing ratio were kneaded by a kneader 6 to homogenize the powdered magnetic material and the binder. The kneaded material 7 was fed under pressure to a primary extruder 8. A molded bar-like body 9, serving as a winding core, which was molded to a desired diameter of 0.5–10 mm, for example, was extruded out of an outlet of the primary extruder 8 at a speed of 30 m/min, for example. This bar-like body 9 was dried in a dryer (not shown). Thereafter, a conducting wire 11 was wound by a winding device 10 around the bar-like body 9. The bar-like body 9 having wound therearound the conducting wire 11 was fed to a secondary extruder 12. To this secondary extruder 12 there was fed in advance under pressure a kneaded material 12 which was kneaded by a kneader 13 and was made up of an inorganic material such as the above-described dielectric material, the magnetic material, glass or the like, and the binder. Therefore, the bar-like body 9 which was discharged out of the secondary extruder 12 and around which was wound the conducting wire 11 was coated or covered on its external periphery with the kneaded material 14. The bar-like body 9 around which the conducting wire was wound and which was coated with the kneaded material 14 was further charged to a tertiary extruder 15. To this tertiary extruder 15 there was fed in advance under pressure the same kneaded material 7*a* as the kneaded material 7 that was fed under pressure to the primary extruder 8. Therefore, the conducting wire 11 wound around the bar-like body 9, and the kneaded material 14 were coated with the kneaded material 7*a,* thereby forming the external cover element. Thereafter, the semi-manufactured product obtained by the preceding steps was cut into a size to suit the size of a sintering furnace or the shape of a setting device on which the semimanufactured product is placed for sintering in the sintering furnace. The semimanufactured product was then sintered at 600–1000° C., in particular at 900° C., and was cut by a cutting device to suit the dimensions of respective inductors. Individual cut inductor main bodies 16 were then subjected to barrel polishing using a barreling powder and water and were rounded at corner portions thereof. Thereafter, a silver paste was coated on both external surface portions of each inductor main body 16 and their adjoining peripheral external portions, and was baked to thereby form external electrodes 3, 3. In this manner, exposed end portions 4, 4 of the conducting wire 1 and the external electrodes 3 were connected to each other. To the silver layer of each external electrode 3 there was applied a nickel plating and a solder plating.

In this embodying example, the shrinkage percentage, at the time of sintering, of the magnetic element inside the coiled conducting wire 1 was made the same as the shrinkage percentage of the magnetic element in the form of the external cover element. Therefore, a stress of the magnetic element as the external cover element due to shrinkage thereof at the time of sintering is not exerted on the magnetic element inside the coiled conducting wire 1 via the coiled conducting wire 1 and/or via the clearance between the adjoining winds of the coiled conducting wire 1. The impedance characteristics of the inductor will therefore be not deteriorated.

The above-described chip inductor can also be manufactured in a method as described hereinbelow which is different from the method shown in FIG. 3.

In FIG. 3, the bar-like body 9 as a winding core having a desired diameter of 0.5–10 mm, for example, 2.6 mm was extruded out of the primary extruder 8 at a speed of 30 m/min., for example. After having dried this bar-like body 9 in a dryer (not shown), a conducting wire 11 was wound by the winding device 10. On an external periphery of the bar-like body 9 having wound therearound the conducting wire 11, there was formed the inorganic material layer 5, as shown in FIG. 1B, by blowing (or spraying) or by dipping an inorganic material such as the above-described dielectric material, the magnetic material, glass or the like onto the external periphery of the bar-like body 9. Thereafter, as shown in FIG. 3, an external cover element was formed by coating the kneaded material 7*a* by the tertiary extruder 15, followed by the same steps as the one shown in FIG. 3, thereby forming a chip inductor.

In FIG. 3, the formed bar-like body 9 serving as the winding core was extruded out of the outlet of the primary extruder 8 at a predetermined speed. After having dried this bar-like body 9 in a dryer (not shown), the conducting wire 11 and an electrically insulating inorganic wire material 17 such as glass or the like were closely wound together. The electrically insulating inorganic wire material 17 may also be a wire material made of a dielectric material. Thereafter, as shown in FIG. 3, an external cover element was formed by coating the kneaded material 7*a* by the tertiary extruder 15, followed by the same steps as the one shown in FIG. 3, thereby forming a chip inductor.

Figure 4:
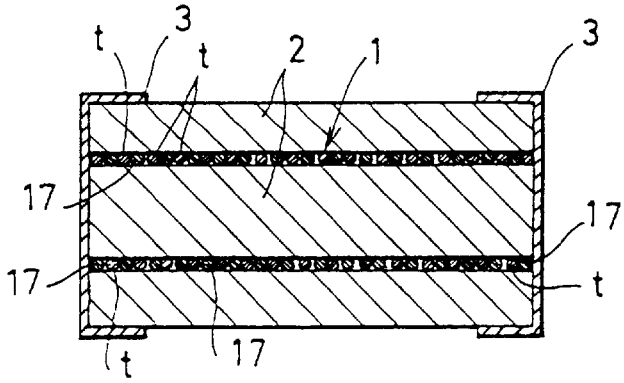
FIG. 4 is a sectional view of another example of the chip inductor according to the present invention.

FIG. 4 shows a chip inductor which was manufactured by the above-described method. As shown therein, like the one shown in FIG. 1B, there is filled an electrically insulating inorganic material between winds t, t on both ends of the conducting wire 1 and both end surfaces of the winding core 2 as well as in the clearance between respective winds t, t of the coiled conducting wire 1.

Figure 5:
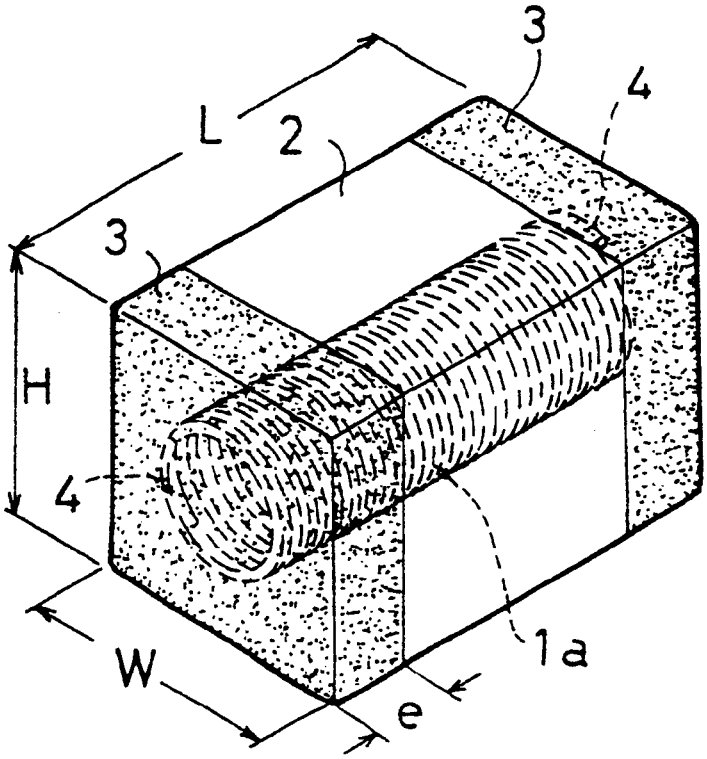
FIG. 5 is a perspective view of a chip inductor using a conducting wire coated on its external surface with an electrically insulating inorganic material.

FIG. 5 shows a still another embodying example of a chip inductor.

Figure 6:
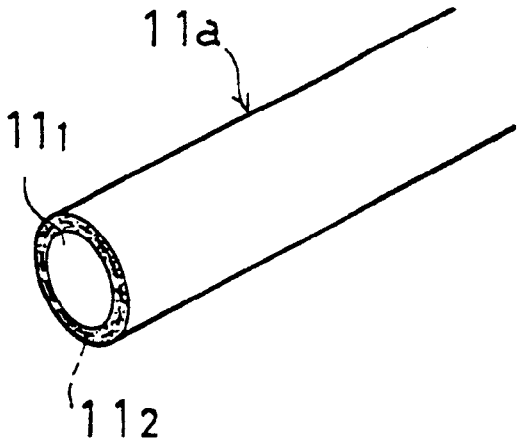
FIG. 6 is a perspective view of the conducting wire coated on its external surface with the electrically insulating inorganic material.

In this Figure, reference numeral 1*a* denotes a conductor wound in a coiled manner (or a coiled conducting wire) by closely winding an insulation-coated conducting wire 11*a* which, as shown in FIG. 6, was coated on its external surface with a coating $\mathbf{11}_2$ of an electrically insulating coating material such as glass or the like which does not burn out, or perish by burning, at the time of sintering and which was made of a silver wire of 20–100 μm in diameter. Reference numeral 2 denotes a magnetic member of a rectangular parallelepiped in which was embedded the coiled conducting wire 1*a* and which was made of ferrite (e.g., L=1.0–10.0 mm, W=0.5–10.0 mm, H=0.5–10.0 mm). Reference numerals 3, 3 denote external electrodes which were made by coating both end surfaces and adjoining external peripheral end portions (e=0–4.0 mm) of the magnetic member 2. The external electrodes 3, 3 were connected to those both end portions 4, 4 of the coiled conducting wire 1*a* which were exposed to both the end surfaces of the magnetic member 2. These external electrodes 3, 3 were made of silver electrodes, for example, and were subjected to nickel plating and lead-tin plating on top thereof.

The above-described magnetic member 2 is made up of an internal magnetic element which serves as a winding core around which the coiled conducting wire 1*a* is wound and a magnetic element which serves as an external cover element to cover or coat the coiled conducting wire 1*a*. The compositions of the internal magnetic element and the external cover element are the same as that of the chip inductor shown in FIG. 1.

Figure 7:
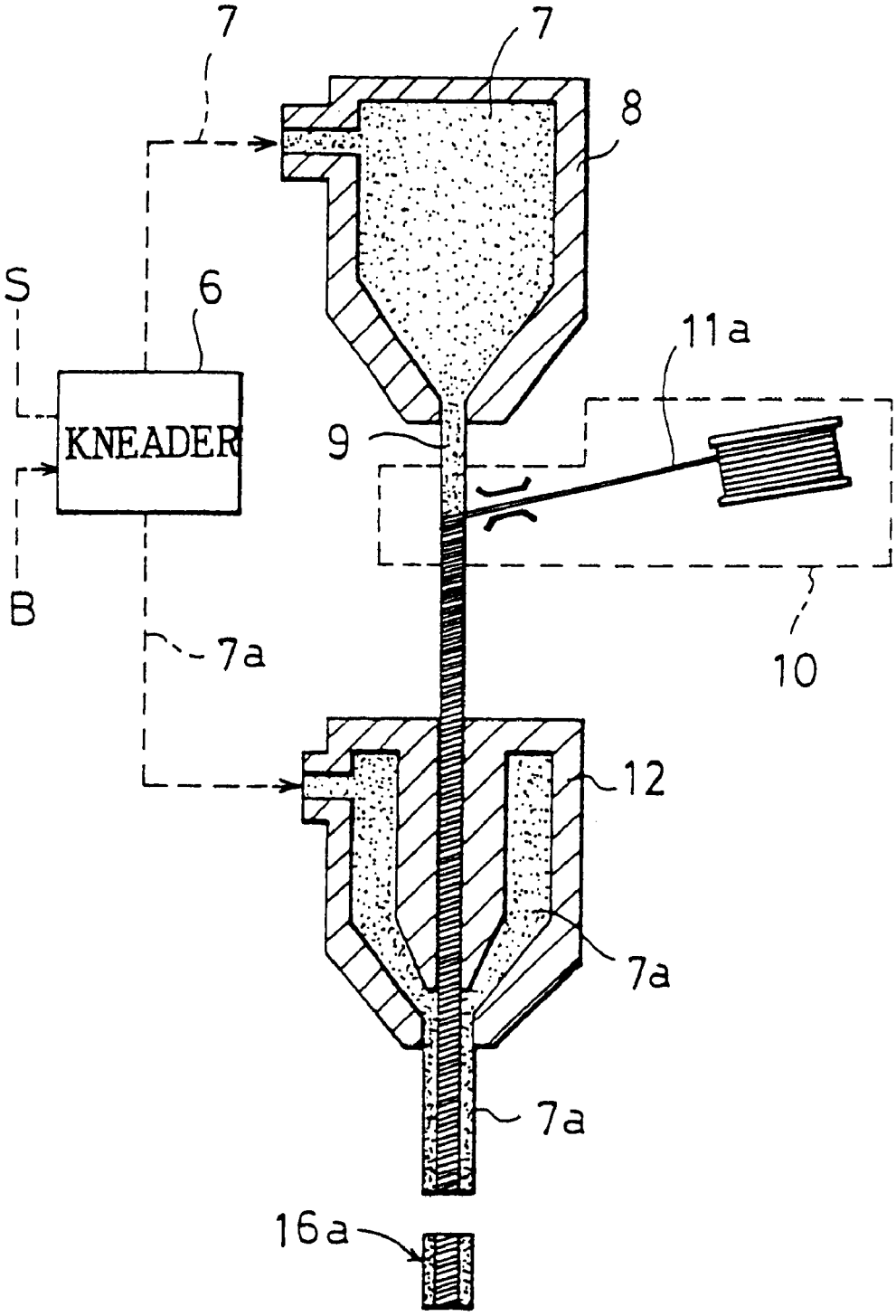
FIG. 7 is an explanation diagram showing a method of manufacturing the chip inductor shown in FIG. 5.

Next, an explanation will now be made with reference to FIG. 7 about the method of manufacturing the chip inductor as shown in FIG. 5. Like in the above-described examples, a powdered magnetic material B of 0.7 μm in particle size and a binder S of glycerine-methyl cellulose in a mixing ratio of 100:8 were kneaded by a kneader 6 to homogenize the powdered magnetic material B and the binder S. The kneaded material 7 was fed under pressure to a primary extruder 8. A molded bar-like body 9, serving as a winding core, which was molded to a desired diameter of 0.5–10 mm, for example, was extruded out of an outlet of the primary extruder 8 at a speed of 30 m/min, for example. This bar-like body 9 was dried in a dryer (not shown). Thereafter, the above-described insulation-coated conducting wire 11*a* coated by the electrically insulating material was closely wound around the bar-like body 9 by a winding device 10. The bar-like body 9 having wound therearound the conducting wire 11*a* coated by the electrically insulating material was fed to a secondary extruder 12. To this secondary extruder 12 there was fed in advance under pressure the same kneaded material 7*a* as the one fed under pressure to the primary extruder 8. Therefore, by this extruder 12 the bar-like body 9 and the insulation-coated conducting wire 11*a* which was wound therearound were coated by the kneaded material 7*a,* thereby forming an external cover element. Thereafter, the semi-manufactured product obtained by the preceding steps was cut into a size to suit the size of a sintering furnace or the shape of a setting device on which the semimanufactured product is placed for sintering in the sintering furnace. The semimanufactured product was then sintered at 600–1000° C., in particular at 900° C., and was cut by a cutting device to suit the dimensions of respective inductors. The individual cut inductor main bodies 13 were then subjected to barrel polishing using a barreling powder and water and were rounded at corner portions thereof. Thereafter, a silver paste was coated on both external surface portions of each inductor main body 16 and their adjoining peripheral external portions, and was baked to thereby form external electrodes 3, 3 as shown in FIG. 5. In this manner, exposed end portions 4, 4 of the conducting wire 1 and the external electrodes 3 were connected to each other. To the silver layer of each external electrode 3 there was applied a nickel plating and a solder plating.

In this embodying example, too, the shrinkage percentage at the time of sintering of the internal magnetic element inside the coiled conducting wire 1*a* has the same shrinkage percentage of the magnetic element serving as the external cover element. Therefore, at the time of sintering, a stress due to shrinkage of the magnetic element serving as the external cover element is not applied to the internal magnetic element via the coiled conducting wire 11*a* which was wound in a coiled manner. Consequently, the impedance characteristics of the inductor are superior to those of the conventional one. Further, when the external electrodes 3, 3 are formed on both end surfaces of the magnetic member 2, the winds on both ends of the coiled conducting wire 1*a* are coated with the coating of the electrically insulating inorganic material. It follows that they are not short-circuited by the conducting paste, with the result that the characteristics of the chip inductor will not vary. In addition, the winds of the coiled conducting wire 1*a* are close to each other and, as compared with the one in which the conducting wire having wound no electrically insulating inorganic material, the winding pitch can be made smaller. Therefore, the impedance characteristics are improved and the product can be made smaller in size. According to this method of manufacturing, the chip inductor can be manufactured at a relatively smaller manufacturing cost.

Figure 8:
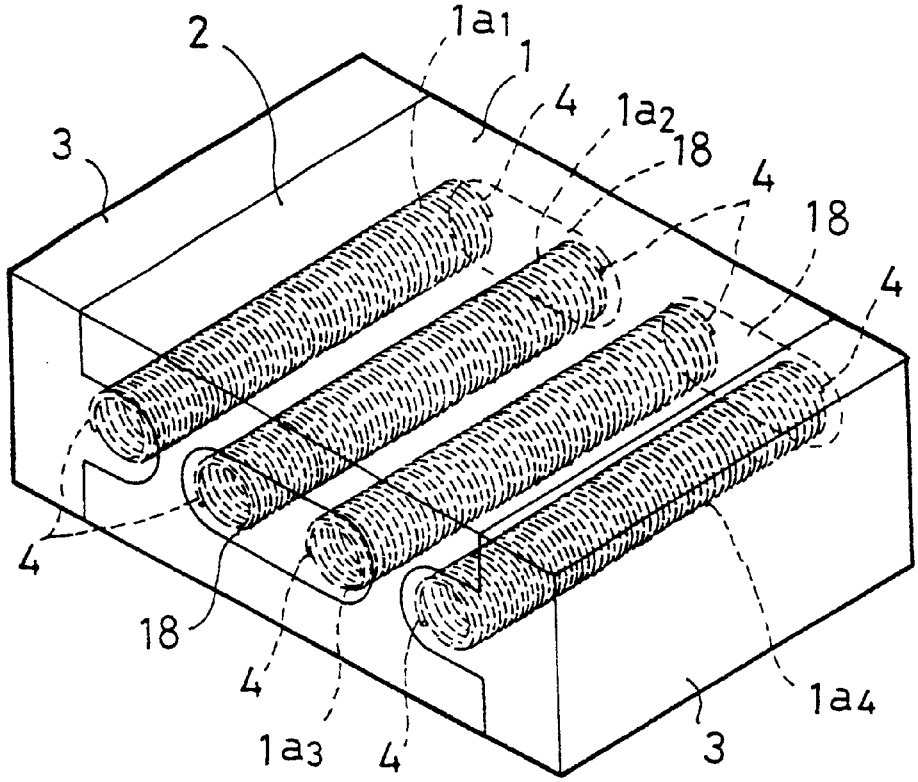
FIG. 8 is a perspective view of another embodying example of the chip inductor using a conducting wire coated on its external surface with an electrically insulating inorganic material.

FIG. 8 shows still another embodying example of the chip inductor of the present invention.

In this chip inductor, inside a magnetic member 2 which is made up of a ferrite of rectangular parallelepiped, there are parallelly embedded four coiled conducting wires $\mathbf{1}a_1$, $\mathbf{1}a_2$, $\mathbf{1}a_3$ and $\mathbf{1}a_4$ each having a similar construction as the coiled conducting wire 1*a* shown in FIG. 5. Both ends of the respective coiled conducting wires $\mathbf{1}a_1$, $\mathbf{1}a_2$, $\mathbf{1}a_3$ and $\mathbf{1}a_4$ are exposed to a front end and a rear end, respectively, of the magnetic member 2 and are respectively connected in series to each other by means of connecting electrodes 18 which are formed on the front and rear end surfaces (directions in the axial direction of the conducting wire are referred to as front and rear). Both ends of the coiled conducting wires $\mathbf{1}a_1$, $\mathbf{1}a_2$, $\mathbf{1}a_3$ and $\mathbf{1}a_4$ which are connected in series are connected to the external electrodes 3, 3 which are formed on both right and left end surfaces (i.e., surfaces located perpendicular to the axial line of each conducting wire) of the magnetic member 2.

Figure 9:
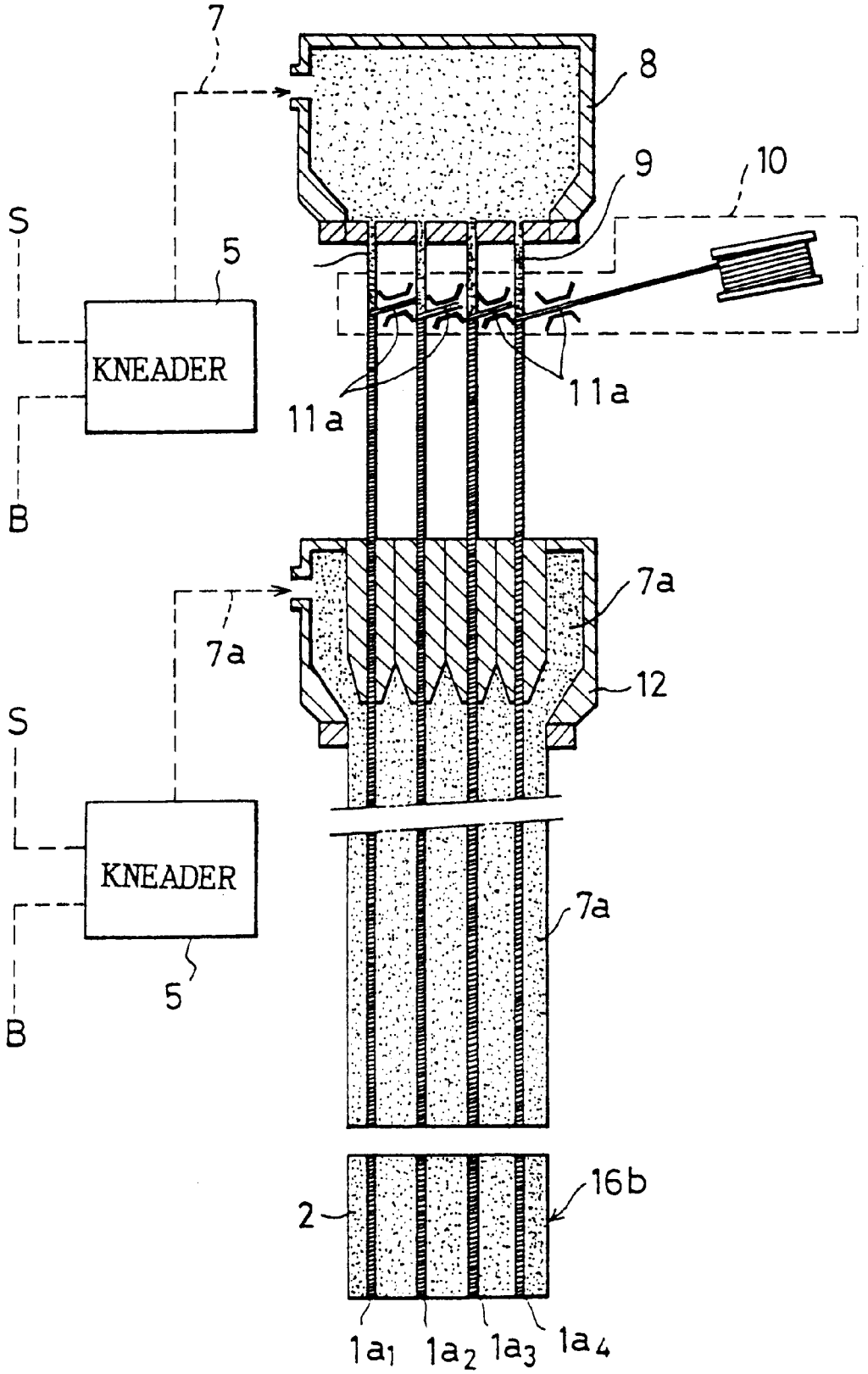
FIG. 9 is an explanation diagram showing a method of manufacturing the chip inductor shown in FIG. 8.

This chip inductor was manufactured in the following manner. As shown in FIG. 9, magnetic bars 9 which are, e.g., four winding cores extruded by a primary extruder 8 and arranged in parallel to each other, were extruded for forming at a speed of 30 m/min. After drying these four bar-like bodies 9, the conducting wires 11*a* were closely wound therearound by a winding device 10. The four bar-like bodies 9 around which the conducting wires 11*a* were wound were continuously coated with a kneaded material 7*a* by a secondary extruder 12 to thereby form the external cover element. After sintering the semimanufactured product obtained in the preceding steps, under similar conditions to those explained with reference to FIG. 7, the product was cut into respective inductor main bodies 16*b*. To these inductor main bodies 16*b* there were formed connecting electrodes 18 and external electrodes 3, 3.

Figure 10:
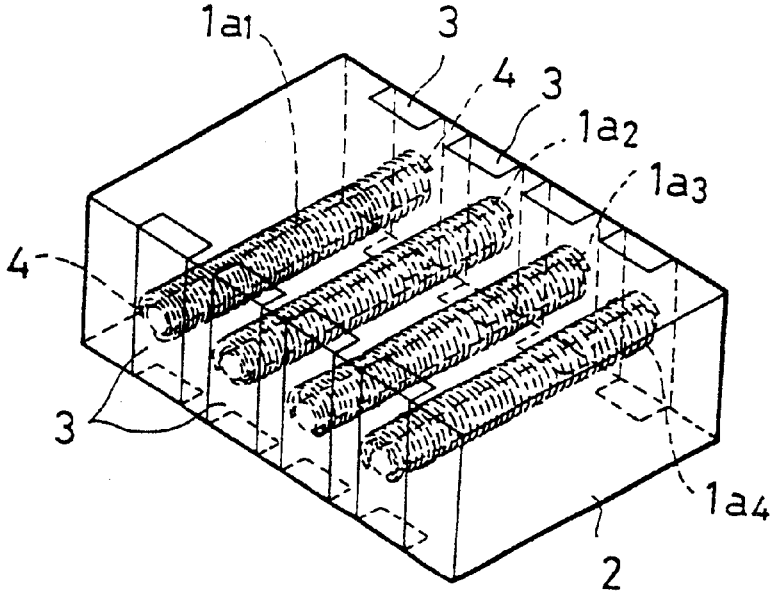
FIG. 10 is a perspective view of a chip inductor array of the present invention.

FIG. 10 shows an embodying example of a chip inductor array according to the present invention.

The main body of this inductor array is the same as the chip inductor main body 16*b* as shown in FIG. 8. There are formed external electrodes 3, 3 which are to be connected to both end portions 4, 4 of each of the coiled conducting wires $\mathbf{1}a_1$–$\mathbf{1}a_4$ embedded in parallel inside the magnetic member 2. This chip inductor array was manufactured by manufacturing the inductor array main body by the same method as that for manufacturing the chip inductor main body 16*b* and thereafter forming the external electrodes 3, 3 on both end surfaces of the magnetic member.

According to the above-described arrangements, there are the following advantages. Namely, an inductor and an inductor array which have no variations in impedance and are superior in mass production can be obtained. Further, a method of manufacturing an inductor and an inductor array that are superior in impedance characteristics and have no variations in impedance can be obtained. In addition, the inductor and inductor array that use a dielectric material as an inorganic material become steeper in attenuation characteristics, when used for removing noises, than the conventional one without the dielectric material, whereby ones superior in the frequency selection characteristics can be obtained.

It is readily apparent that the above-described chip inductor and chip inductor array as well as the methods of manufacturing the same meet all of the objects mentioned above and also have the advantages of wide commercial utility. It should be understood that the specific form of the invention hereinabove described is intended to be representative only, as certain modifications within the scope of these teachings will be apparent to those skilled in the art.

Accordingly, reference should be made to the following claims in determining the full scope of the invention.

What is claimed is:

1. A method of manufacturing a chip inductor array comprising the steps, in the order mentioned, of:

forming a plurality of parallel elongated winding cores by extruding a kneaded material which is obtained by kneading a powdered magnetic material and a binder;

closely winding a conducting wire in a coiled manner around each of said winding cores, and then coating said conducting wire on an external surface thereof with an electrically insulating inorganic material which is free from perishing by sintering;

forming an external element by extruding said kneaded material to continuously cover each of said winding cores and each of said coiled conducting wires, said winding cores and said external cover element constituting a magnetic member;

sintering said winding cores and said external cover element to thereby obtain a continuously formed chip inductor array main body;

cutting said continuously formed chip inductor array main body into a predetermined length to thereby obtain a plurality of cut chip inductor array main bodies; and forming external electrodes which are respectively connected to exposed end portions of each of said plurality of winding cores, said external electrodes being formed on external surfaces of said magnetic member.

2. A method of manufacturing a chip inductor array according to claim 1, wherein a mixing ratio of said powdered magnetic material and said binder of said winding core is equal to a mixing ratio of said powdered magnetic material and said binder of said external cover element, and wherein a particle size of said powdered magnetic material for said winding core is equal to a particle size of said powdered magnetic material for said external cover element such that a shrinkage percentage of said winding core becomes equal to a shrinkage percentage of said external cover element.

* * * * *

UNITED STATES PATENT AND TRADEMARK OFFICE

CERTIFICATE OF CORRECTION

PATENT NO. : 6,343,413 B1
DATED : February 5, 2002
INVENTOR(S) : Hiroyuki Masuda et al.

It is certified that error appears in the above-identified patent and that said Letters Patent is hereby corrected as shown below:

Column 12,
Line 5, change "parallel elongated" to -- parallelly disposed elongated --; and
Line 13, change "an external element" to -- an external cover element --.

Signed and Sealed this

Second Day of July, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,343,413 B1
DATED : February 5, 2002
INVENTOR(S) : Masuda et al.

It is certified that error appears in the above-identified patent and that said Letters Patent is hereby corrected as shown below:

Title page,
Item [62], Related U.S. Application Data change "filed on Oct. 7, 1995" to be
-- filed on Oct. 17, 1995 --

Signed and Sealed this

Fourteenth Day of January, 2003

JAMES E. ROGAN
*Director of the United States Patent and Trademark Office*